United States Patent [19]

Cosby et al.

[11] 4,086,120

[45] Apr. 25, 1978

[54] WEB GUIDES FOR CORRUGATOR MACHINES

[75] Inventors: James L. Cosby, Parkville; Gordon L. Morgret, Baltimore, both of Md.

[73] Assignee: Koppers Company, Inc., Pittsburgh, Pa.

[21] Appl. No.: 687,906

[22] Filed: May 19, 1976

Related U.S. Application Data

[63] Continuation-in-part of Ser. No. 596,407, Jul. 16, 1975.

[51] Int. Cl.[2] ..... B31F 1/00

[52] U.S. Cl. ..... 156/473

[58] Field of Search ..... 156/470, 473, 205–208, 156/210; 118/245

[56] References Cited

U.S. PATENT DOCUMENTS

| | | | |
|---|---|---|---|
| 1,106,502 | 8/1914 | Ferres | 156/473 |
| 3,484,320 | 12/1969 | David | 156/473 |
| 3,630,806 | 12/1971 | Kitajima | 156/210 |
| 3,951,725 | 4/1976 | Bradley et al. | 156/473 |

*Primary Examiner*—David A. Simmons

*Attorney, Agent, or Firm*—Thomas L. Sivak; Oscar B. Brumback

[57] ABSTRACT

An improved web guide structure of the self-adjusting type for a corrugated web single-facer machine including a plurality of laterally spaced guides for continuously and yieldably urging a corrugated medium web against a lower corrugator roller, a support rigidly mounted to the single-facer for pivotally supporting the guides, and a gravity-actuated and adjustable biasing means for urging the guides against the corrugated web at preselected pressures. The guides preferably include a trailing guide portion that remains in engagement with an adhesive applicator roll when the roll is moved out of engagement with the corrugated web to maintain alignment of the guides with the roll. Springs may also be used in conjunction with the support to apply greater or lesser pressure to all of the guides simultaneously.

The method includes applying pressure at selected lateral locations across the width of the corrugated web, such pressure being yieldably applied to each of the guides by an elastic member or by gravity-actuated counter-weights.

6 Claims, 1 Drawing Figure

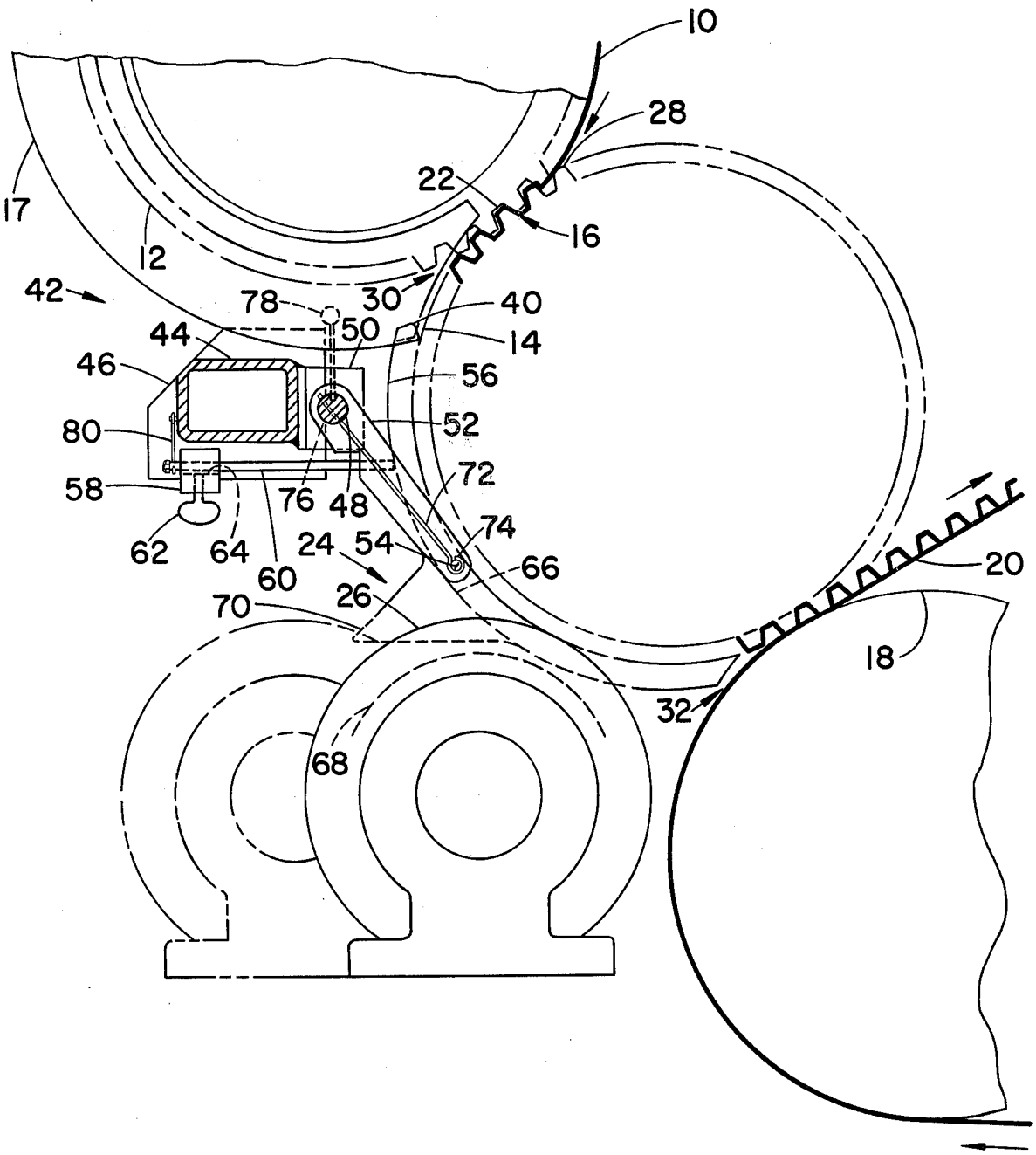
10
28
22
16
17
12
42
78
30
40
44
50
14
46
56
80
52
72
58
76
48
74
62
64
24
54
66
20
60
26
70
18
32
68

WEB GUIDES FOR CORRUGATOR MACHINES

Cross-Reference to Related Applications

This invention is a continuation-in-part of application Ser. No. 596,407 filed on July 16, 1975, by James L. Cosby and Gordon L. Morgret entitled "Corrugating Machine Having Self-Adjusting Web Guides" and assigned to the assignee of the present invention, such prior application being incorporated by reference herein.

BACKGROUND OF THE INVENTION

1. Field of the Invention

This invention relates generally to surface bonding on an indefinite or running length of flexible web and means for applying a separate web to a shaped web and more particularly to a corrugated web single-facer machine having self-adjusting web guides for holding a corrugated medium web against a corrugator roll in the single-facer.

2. Description of the Prior Art

The prior application, of which this is a continuation-in-part, has set forth the state of the art relating to web guides for the corrugated medium web in a single-facer machine. The invention of the prior application largely overcame the shortcomings and disadvantages of prior art machines; however, the present invention generally seeks to simplify and improve the effectiveness of the earlier invention. In particular, an object of the present invention is to eliminate the need for a separate fluid supply for expanding the elastic tube used to urge the guide members against the corrugated medium web, to eliminate the mounting of the guide structure for movement with the adhesive applying structure and yet maintain alignment of the guides with the adhesive applicator roll, and provide a means for applying greater or lesser pressure to all the guides simultaneously. This invention also embraces the method of applying yieldable preselectable pressure to the corrugate medium web at selected lateral locations along its width.

It is also an object of this invention to provide a method and apparatus superior to fixed types of web guides such as illustrated in U.S. Pat. Nos. 2,979,112; 3,220,911; and 3,366,527. Web guides such as shown in these patents are rigidly mounted and require individual adjustment to maintain the medium web in contact with the lower corrugating roll. In addition, they are subject to bending and breakage from splices and other irregularities in the paper stock and usually require readjustment as they become worn.

It is an additional object of this invention to provide a method and apparatus superior to non-fixed types of web guides such as illustrated in U.S. Pat. Nos. 3,630,806 and 3,951,725. For example, U.S. Pat. No. 3,630,806 shows a web guide pivoted on its end nearest the entrance of the corrugate medium between the guide and the lower corrugating roller; the opposite end of the guide is urged by spring pressure against the corrugated medium to press the medium against the lower corrugator roll. This arrangement is semi-rigid because of the pivot point 22*a* and does not allow for extra thickness of paper passing between the guide and its associated lower corrugating roll. In addition, some sort of readjustment would be needed to compensate for wear of the guides. The present invention overcomes such problems as will be hereinafter explained.

U.S. Pat. No. 3,951,725 shows a two-piece hinged web guide pivotably supportedfrom a fixed support; the two segments of the guide are independently urged by spring pressure against the lower corrugator roll. However, it should be noted that the segments are fixed to their supports and perfect alignment of the segments on the supports is necessary to achieve continuous contact of the segments against the corrugated medium web. It can also be seen that movement of the guide segments is limited by the hinge arrangement 77 joining the segments together, particularly in the embodiment of FIG. 4 and as pointed out in the specification in column 5, lines 18–27. Accordingly, it is an object of the present invention to provide a method and structure overcoming such disadvantages and, particularly, to provide a single-piece guide structure capable of great freedom of movement to compensate for irregularities in the corrugated medium web and requiring no readjustment to compensate for ordinary wear of the web guides as will be hereinafter explained.

SUMMARY OF THE INVENTION

The foregoing and other objects and advantages are generally achieved by a web guide structure including a plurality of laterally spaced guides for continuously urging a portion of the corrugated medium web against the lower corrugator roll, a support means rigidly secured to the single-facer machine for pivotally supporting each of the web guides in engagement with the medium web, and a biasing means connected to each of the guide means for urging them against the medium web at a preselected yieldable pressure. The biasing means preferably comprises a counterweight attached to each guide means so as to exert a force urging the guide means against the web thus requiring no external pressure or energy source for such purpose. The position of the counterweights is preferably adjustable to achieve a preselected desired pressure. In addition, the guide means are provided with a trailing guide portion arranged to remain in circumferential grooves in the adhesive applicator roll to maintain alignment of the guides with the roll as the roll is moved away from and toward the corrugated medium web. If desired, springs may be attached to each of the guides and a support shaft on the guide support so that, upon rotation of the shaft, greater or lesser pressure is exerted simultaneously by all the guides besides that provided by the counterweights.

The method embraces the usual steps performed in making the corrugated medium and the additional step of applying yieldable pressure to the corrugated web, at each of several laterally spaced locations along the width thereof, as the web passes around the lower corrugator roll. Preferably, such pressure is applied to the guide means which in turn transmit the pressure to the web. The pressure may be in the form of fluid pressure exerted by a tube expanded against the guide means or in the form of pressure exerted by a counterweight acting on the guide means.

The foregoing and other objects and novel features of the invention will appear more fully in the following detailed description when the same is read in connection with the accompanying drawing. It is to be expressly understood, however, that the drawing is not intended as a definition of the invention but is for the purpose of illustration only.

BRIEF DESCRIPTION OF THE DRAWING

The FIGURE is a schematic illustration in side elevation of a portion of a corrugated web single-facer machine showing the upper and lower corrugator rolls, the pressure roll for applying the single-face liner, a portion of the adhesive applying structure, and the improved, self-adjusting web guide structure of the present invention.

DESCRIPTION OF THE PREFERRED EMBODIMENT

Referring now to the drawing, a corrugated medium web 10 to be corrugated is directed between an upper corrugator roll 12 and a lower corrugator roll 14 to form a corrugated web 16 in the well-known manner. The corrugated web 16 is stripped from the upper roll 12 by a conventional stripper 17 and is guided, in the manner and by means to be explained, around a circumferential portion of the lower roll 14 and then between the lower roll and a conventional pressure roll 18 acting against the lower corrugator roll where a single-face liner web 20 is applied to the corrugated medium web in the usual manner. As the corrugated web 16 passes around lower roll 14, adhesive is applied to the flute tips 22 of web 16 by an adhesive applicator structure generally denoted by numeral 24 and specifically by adhesive applicator roll 25. Thus, when the liner web 20 is pressed into contact with the tips 22, an adhesive bond is formed to join the webs 16 and 20 by the pressure between lower roll 14 and pressure roll 18 and by the heat transferred to the webs by both rolls which are usually steam-heated as well understood by those skilled in the art. After such bonding, the double-ply web is guided to other machinery (not shown) for further processing.

As pointed out in the prior invention previously referred to, it is extremely important to keep the corrugated portion of the medium web 16 in close contact with the flutes 28 of the lower roll 14 as it passes out of the nip 30 formed by the upper and lower rolls 12 and 14 and travels to the nip 32 formed by the lower roll 14 and pressure roll 18. Doing so permits an even application of adhesive to the flute tips 22 and also assures stable bonding of the webs 16 and 20. If the web 16 is allowed to fluff out from the lower corrugator roll 14, then too much or too little adhesive is applied or sometimes none at all in some areas. This results in what is called "loose-back" single-face paperboard and sometimes results in "blistered" areas. In addition, if the web 16 fluffs out, then too much lineal footage of paper may be supplied between the lower roll 14 and pressure roll 18 as compared to the lineal footage of the liner web 20. Thus, as the web 16 moves back into the flutes of roll 14 as its passes through nip 32, the previously formed flutes in web 16 may be crushed and reformed which results in weakened and inferior grade single-face web. Slight fluffing may also result in so-called "hi-lo" flutes where some of the flutes in the medium web 16 are higher and lower than their nominal size.

It has been customary for many years to use a rigid guide structure to prevent the corrugated medium web 16 from fluffing out from the lower corrugated roll 14. As pointed out in the prior specification, rigidly mounted guides required considerable and difficult adjustment to maintain the web 16 in close contact with the roll. In addition, as paper web thicknesses were changed for making different paperboard stocks, the adjustments had to be changed; similar adjustments had to be made to compensate for double thickness webs when the rolls of paper stocks were spliced. Part of the problem was overcome by spring loading the entire guide assembly so that all the guides moved away from the lower roll to compensate for different paper thicknesses, splices and other irregularities. Nevertheless, the guides were often bent or broken by jam-ups of paper in the machine. In addition, the guides tended to wear unevenly because of non-uniformity of the guide material (usually brass) and from non-uniformity of the material and thickness of the paper stock.

The invention of the prior referred to application overcame the foregoing and other problems by providing for resilient, individual biasing of the guides against the web 16. Thus, if one guide wore more rapidly than another, it automatically pressed against the web at a pressure determined by the pressure in the expandable tube used in the invention. This also permitted the guides to compensate for different paper thicknesses, splices, and jam-ups and to return to the proper operating position at all times. In this sense, the guides were self-adjusting. Nevertheless, the prior invention required the use of a source of fluid pressure to expand the expandable pressure tube and, in one embodiment, required the guide assembly to be mounted to the adhesive applicator structure to maintain alignment between the guides and the circumferential grooves in the adhesive applicator roll.

In accordance with this invention, no separate source of fluid pressure is needed and the guide structure may be rigidly mounted to the side support frames (not shown) of the single-facer machine. As shown in the drawing, a plurality of guides 40 are laterally spaced across the width of the machine, as explained in the prior application, and are arranged to continuously urge the corrugated portion 16 of web 10 against the lower corrugator roll 14 between the upper nip 30 and lower nip 32 as the web advances around the roll. The guides 40 are supported on a support structure generally denoted by numeral 42. Specifically, support structure 42 includes a rigid beam member 44 spanning the width of the machine and secured to the side frames (not shown) thereof by brackets 46 in any convenient manner. A support shaft 48 is secured to the beam 44 such as by brackets 50 welded to the beam. Connecting links 52 are pivotally mounted upon the support shaft 48 as shown and each of the links are pivotally mounted to one of the guides 40 such as by a pin 54. The pin 54 may by rigidly secured to either the associated guide 40 or to the connecting link 52, such as by welding or press-fitting it in a hole in the well-known manner, so as to provide a somewhat loose-fitting pivotal connection. Thus, it can be seen that this arrangement permits the guides 40 to swivel or pivot around shaft 48 and pin 54 into exact arcuate contact with the web 16 and, when under pressure, to urge the web 16 evenly against the lower roll 14 with the flutes of the paper resting in the flutes of the roll. As shown in the drawing, the guides are formed with a concave, arcuate portion 56 that corresponds in shape and size to the lower roll 14 plus the thickness of paper ordinarily used.

To maintain pressure between the guides 40 and web 16, a counterweight 58 is slidably mounted to a conventional bolt 60 threaded into each connecting link 52. A thumbscrew 62 threaded into the counterweight 58 as shown engages the bolt 60 passing through a hole 64 in the counterweight to maintain the weight in a selected position along bolt 60. The size of the counterweight is selected such that when it is located in its outermost position as shown, it will more than equal the amount of force necessary to pivot the weight of the associated guide 40 and connecting link 52 to urge the guide 40 against web 16 at the maximum pressure desired. Thus, the pressure exerted by the guide is proportional to the weight of the counterweight. It can also be seen that as the counterweight 58 is moved inwardly toward the connecting link 52, it will exert less force to urge the guide 40 against the web. The arrangement is such that when the counterweight is moved inwardly to its lowest pressure applying position, the guide 40 will exert no force against the web. If desired, it may be moved so as to cause the guide to move away from the web. In this manner, the counterweight may be moved anywhere along the bolt 60 to provide the desired pressure of the guide 40 against web 16 and locked in the desired position by thumbscrew 62. It can also be seen that if the guide 40 is forced away from roll 14 by a splice in the paper, extra paper thickness, a jam-up, or other irregularity, the counterweight 58 is merely pivoted upwardly from the position shown and will automatically return the guide 40 to its proper position when such irregularity is removed. In addition, as the surface 56 of the guide 40 wears during use, the counterweight will maintain the guide in its proper position. Thus, the guide structure is self-adjusting and provides a biasing means connected to each guide for urging it at a preselected pressure against the web but is also yieldable for the reasons stated.

As pointed out in the prior application, the adhesive applicator structure must be moved from the lower roll 14 from time to time for cleaning and the like. The amount of movement to the furthermost cleaning position is such that an ordinary guide, shaped as shown by the dotted line 66, would come out of the laterally spaced circumferential grooves 68 formed in the glue applicator roll 26 when the structure is moved away from the lower corrugator roll 14 unless the guide structure is arranged to move with the adhesive structure 24. However, it will be appreciated by those skilled in the art that it is often necessary to retract the adhesive structure 24 but still maintain the web 16 in contact with the lower roll 14. In accordance with this invention, the guides 40 are provided with a trailing guide portion 70 extending into the grooves 68 of the adhesive applicator roll 26. The guide portion 70 is shaped as shown in the drawing and is long enough to remain in the groove 68 even when the adhesive assembly is retracted to its furthermost or inactive position. This arrangement maintains the alignment of the guides 40 in the grooves 68 when the adhesive structure is in its active or inactive position and still permits the guides 40 to exert the desired pressure against web 16. Thus, it can be seen that the guide structure may be rigidly mounted to the single-facer machine so that additional structure is not needed to have it move with the adhesive structure and provides the additional advantage of allowing the guides to hold the web 16 in the proper position even with the adhesive structure in its retracted position.

If desired, the guides 40 may be coated with a coating of polytetrafluoroethylene or a similar low friction coating to prevent adhesive build-up on the guides 40. Such adhesive build-up, especially on the lower tip portion of the guides, may eventually add enough weight to counteract the force exerted by the counterweights 58. Only the lower tip portion of the guides 40 may be coated if desired.

As an additional feature, each connecting link 52 may be provided with a spring-steel wire 72 arranged as shown for connection with pivot pin 54 by a loop 74. The opposite end of spring 72 passes through a hole 76 in support shaft 48. In this manner, the spring is secured to the guides 40. The support shaft 48 can easily be made to partially rotate in the brackets 50 so that upon rotation of shaft 48 in a counterclockwise direction, additional resilient pressure is imparted to all the guides simultaneously in addition to the pressure provided by the counterweights 58. Conversely, clockwise rotation of shaft 48 will relieve the pressure exerted by all the guides simultaneously. Shaft 48 may be made to extend through one of the side frames (not shown) of the single-facer machine for accessability and be provided with a conventional handle 78 for rotating shaft 48. A suitable clamping means (not shown) may be used to clamp the handle 78 and shaft 48 in the desired position.

The foregoing spring feature may be desirable to obtain additional guide pressure when unusually stiff medium web paper is being processed or to relieve the pressure when the preset counterweight pressure is too great for the paper being processed, all without the necessity of readjusting the counterweights individually. Such arrangement, in the neutral position shown, will not interfere with normal operation of the counterweights except that the size of the counterweights must be selected to compensate for the tension provided by the spring 72. If desired, the counterweights might not be used and the springs 72 used solely to provide pressure to urge the guides 40 against the web 16. In such instances, however, there would be no provision for individual adjustment of the pressure exerted by each guide means. The springs 72 also serve to damp vibration of the guides 40 caused by their riding against the medium web 16.

It should also be understood that the width of the medium web 16 is often less than the width of the lower corrugator roll 14. Thus, those of guides 40 situated beyond the width of web 16 may ride against the bare corrugator roll which may tend to wear both the guides and the roll. Accordingly, a simple hook 80, shaped similar to an ordinary screen-door hook, may be pivotally pinned to the beam 44 as shown in the drawing. The hook is arranged to engage the bolt 60 in a manner so as to lift the bolt upon engagement and thereby pivot the associated guide 40 away from the roll 14. In this manner, any guides 40 situated beyond the width of web 16 may be disengaged from the roll 14; that is, selected ones of the guide means may be moved to an inoperative position.

In summary, it can be seen from the foregoing description that the present invention provides a self-adjusting web guide structure for a corrugated web single-facer machine wherein a plurality of laterally-spaced guide means continuously urge a corrugated portion of the medium web against the lower corrugator roll as such portion advances around the corrugator roll to pass between it and the pressure roll, such guide means being urged by a gravity responsive means against the corrugated portion of the web at a preselected pressure.

It can also be seen that the support means for the guide means includes a support means rigidly secured to the single-facer machine and that the pivotable connections of the connecting links to both the guide means and rigid support means results in an articulated means that permits relative motion between the guides and the articulated means and relative motion between the articulated means and the rigid support to achieve exact alignment of the arcuate portion of the guide means with the lower corrugator roll and permits substantially unrestricted movement of the guide means toward and away from the lower corrugator roll. The counterweights attached to the connecting links serve as the biasing means for urging the guides against the corrugated portion at a preselected pressure to compensate for irregularities in the medium web and provide self-adjustment of the guide structure.

From the foregoing, it can be seen that the method of operation embraces the step of applying pressure at laterally spaced locations along the width of the web 16, such pressure being yieldably applied at each such location to compensate for irregularities in the web, such step being in addition to the normal steps performed in the formation of the web of single-face paperboard web. The method of operation also embraces the step of applying such yieldable pressure to each of the guides either by a fluid pressure means or by selectively applying the weight of a counterweight to each of the guide means. Otherwise, the operation of the various structures is believed evident from the foregoing description and from the description given in the prior application.

Accordingly, the invention having been described in its best embodiment and mode of operation, that which is desired to be claimed by Letters Patent is:

1. An improved self-adjusting web guide structure for a corrugated web single-facer machine of the type including: cooperating upper and lower corrugator rolls between which a paper medium web is passed to form corrugations therein; adhesive roll means, movable toward and away from said lower corrugator roll, for applying adhesive to the flute tips of said corrugations as said web passes around said lower corrugator roll; and a pressure roll means for pressing a liner web against said flute tips having adhesive thereon, the improvement comprising:

a plurality of laterally-spaced guide means for continuously urging a corrugated portion of said medium web against said lower corrugator roll as said portion advances therearound to pass between said lower corrugator roll and said pressure roll means, a support means rigidly secured to said single-facer machine, said support means including a support shaft extending along the length of said support means, an articulated means comprising a plurality of connecting links pivotally supported on said support shaft and pivotally connected to each of said guide means for providing exact alignment of an arcuate portion of said guide means with said lower corrugator roll and permitting substantially unrestricted movement of said guide means toward and away from aid lower corrugator roll, biasing means connected to each of said articulated means for urging said guide means against said corrugated portion at a preselected pressure, said biasing means being yieldable to compensate for irregularities in said corrugated portion of said web to provide self-adjustment of said web guide structure, and an adhesive applicator roll having a plurality of laterally spaced circumferential grooves in alignment with said guide means for receiving a portion of said guide means therein to enable said guide means to extend partially around said lower corrugator roll between it and said applicator roll when the latter roll is in adhesive applying engagement with said corrugated portion of said web, said guide means each include a trailing guide portion adapted to remain in said grooves when said applicator roll is moved to an inactive position out of engagement with said lower corrugator roll.

2. The apparatus of claim 1 wherein said biasing means includes:

a counterweight means connected to each of said articulated means for urging said guide means against said corrugated portion of said medium web at a pressure proportional to the weight of said counterweight means.

3. The apparatus of claim 2 wherein said counterweight means is selectively movable between a high pressure applying position and a low pressure applying position for varying said preselected pressure of said guide means against said corrugated portion of said web.

4. The apparatus of claim 3 wherein said articulated means includes:

a resilient spring means secured to each of said guide means and to said support shaft operable upon partial rotation of said support shaft for simultaneously increasing or decreasing the pressure applied to said corrugated portion of said web by all of said guide means.

5. The apparatus of claim 3 wherein at least a lower tip portion of said guide means includes a coating of low friction material.

6. The apparatus of claim 3 further including:

hook means, supported by said support means, engageable with selected ones of said guide means for moving said selected guide means to an inoperative position.

* * * * *